US007602162B2

(12) United States Patent
Bansal et al.

(10) Patent No.: US 7,602,162 B2
(45) Date of Patent: Oct. 13, 2009

(54) VOLTAGE REGULATOR WITH OVER-CURRENT PROTECTION

(75) Inventors: Nitin Bansal, Gurgaon (IN); Rupesh Khare, Ghaziabad (IN); Amit Katyal, Ghaziabad (IN)

(73) Assignee: STMicroelectronics Pvt. Ltd., Greater Noida (IN)

( * ) Notice: Subject to any disclaimer, the term of this patent is extended or adjusted under 35 U.S.C. 154(b) by 340 days.

(21) Appl. No.: 11/604,655

(22) Filed: Nov. 27, 2006

(65) Prior Publication Data

US 2007/0194768 A1 Aug. 23, 2007

(30) Foreign Application Priority Data

Nov. 29, 2005 (IN) ..... 3198/DEL/2005

(51) Int. Cl.
*G05F 1/573* (2006.01)

(52) U.S. Cl. ..... 323/277

(58) Field of Classification Search ..... 323/265, 323/268, 269, 274, 276, 277, 280, 315
See application file for complete search history.

(56) References Cited

U.S. PATENT DOCUMENTS 3,771,021 A * 11/1973 Bierly ..... 361/18
6,573,694 B2 * 6/2003 Pulkin et al. ..... 323/273
6,600,299 B2 * 7/2003 Xi ..... 323/280
6,664,773 B1 * 12/2003 Cunnac et al. ..... 323/277
6,690,147 B2 * 2/2004 Bonto ..... 323/280
6,897,638 B2 * 5/2005 Miyanaga et al. ..... 323/274
7,106,032 B2 * 9/2006 Chen et al. ..... 323/269
7,411,376 B2 * 8/2008 Zhang ..... 323/277
2003/0011952 A1 1/2003 Fukui
2004/0004467 A1 * 1/2004 Miyanaga et al. ..... 323/277
2008/0169795 A1 * 7/2008 Wang ..... 323/280

OTHER PUBLICATIONS (3errit W. den Besten and Bram Nauta, "I::mbedded ,5 V-tO-3.3 V Voltage Regulator for Supplying Digital IC's in 3.3 V CMOS Technology," IEEE Journal of Solid-State Circuits, vol. 33, No. 7, dated Jul. 1998.*

Gerrit W. den Besten and Bram Nauta, "Embedded 5 V-to-3.3 V Voltage Regulator for Supplying Digital IC's in 3.3 V CMOS Technology," IEEE Journal of Solid-State Circuits, vol. 33, No. 7, dated Jul. 1998.

* cited by examiner

*Primary Examiner*—Adolf Berhane
*Assistant Examiner*—Yemane Mehari
(74) *Attorney, Agent, or Firm*—Gardere Wynne Sewell LLP

(57) ABSTRACT

A linear regulator with an N-type pass transistor includes an over-current protection circuit. A current sink is used as an indicator for an over-current condition and is coupled to the output of the linear regulator. The indicator is coupled to a feedback logic circuit that controls the current through the output load. The over-current protection circuit extensively uses N-type devices for various components including the output driver stage in the circuit. This results in reduced area for the over-current protection circuit.

14 Claims, 8 Drawing Sheets

VOLTAGE REGULATOR WITH OVER-CURRENT PROTECTION

PRIORITY CLAIM

The present application claims priority from Indian Application for Patent No. 3198/Del/2005 filed Nov. 29, 2005, the disclosure of which is hereby incorporated by reference.

BACKGROUND OF THE INVENTION

1. Technical Field of the Invention

The present invention relates to the field of voltage regulators and, in particular, to a linear voltage regulator having an NMOS driving stage with over-current protection.

2. Description of Related Art

A voltage regulator provides a regulated power supply to a system. Various architectures for a regulator exist ranging from linear regulators, that are simple and easy to implement, to switching regulators, that are complex but have high efficiency.

The regulated supply can be used for either off-chip or on-chip purposes. The supply that is going off-chip may encounter a situation where the output pin is erroneously shorted to ground. Huge currents might flow through the regulator resulting in damage to the circuit. Also, during startup, large currents flow through the regulator. In order to avoid such a situation, current limiting circuits are added to the regulator that provide a soft-start and also limit the current if it exceeds a preset value.

The linear regulators known in the art may use a PMOS or NMOS device for an output driver making it a low drop out (LDO) regulator. Use of PMOS driver device is done to make a low drop out regulator. These regulators usually have a loop whose stability is dependent on the capacitive load applied to the regulator. However, an open loop linear regulator also exists that provides a solution whose stability is independent of the capacitive load. This makes such a regulator extremely useful in cases where the load may have a large variation. Such a regulator has been discussed in the paper "Embedded 5 V-to-3.3 V Voltage Regulator for Supplying Digital IC s in 3.3 V CMOS Technology" in IEEE JOURNAL OF SOLID-STATE CIRCUITS.

An improvement of a normally used technique for an LDO with a PMOS driver is discussed in the published United States Patent Application No. 2003011952. FIG. 1 shows a configuration of a conventional over-current protection circuit for a voltage regulator with PMOS as an output driver. A reference voltage source 103 supplies a constant-voltage Vref to an inverting input terminal of an error amplifier 101. Output of the error amplifier 101 is connected to a gate of a PMOS output driver transistor 105, and is also connected to a gate of a PMOS sense transistor 111 and a drain of a PMOS transistor 119 of an over-current protection circuit. A source of the PMOS output driver transistor 105 is connected to an input terminal IN and a drain of the same is connected to an output terminal OUT. A voltage dividing circuit consisting of resistors 107 and 109 supplies a divided voltage of an output voltage VOUT to a non-inverting input terminal of the error amplifier 101.

In the case where the PMOS output driver transistor 105 and the first PMOS sense transistor 111 are operating in the saturated state, the amount of current flowing through the pmos sense transistor 111 is in proportion to the current flowing through the output driver pmos transistor 105. A voltage difference generated across the resistor 113 is small and the NMOS transistor 115 is in a non-conducting state.

Therefore, since a current does not flow to the NMOS transistor 115, a voltage difference is not generated across the resistor 117 and the PMOS transistor 119 is also in a non-conducting state.

However, when a current supplied by the PMOS output driver transistor 105 increases, current flowing to the PMOS sense transistor 111 also increases in proportion thereto and the voltage generated across the resistor 113 also increases. Thus, the NMOS transistor 115 starts conducting. When the NMOS transistor 115 becomes conductive and a voltage difference generated across the resistor 117 increases, the PMOS transistor 119 conducts increasing the gate voltage of the PMOS output driver transistor 105. Thus, a driving ability of the PMOS output driver transistor 105 decreases and an output voltage OUT falls.

While the above over current protection system can be used in voltage regulators with a PMOS driver stage, no such over current protection circuitry is available for voltage regulators with NMOS devices at the driving stage. In many applications, voltage regulators with NMOS driver stage are preferred as PMOS devices consume a relatively larger amount of silicon area.

FIG. 2 shows a circuit that improves the previous technique. The circuit makes the operating states of the PMOS output driver transistor 105 and the first PMOS sense transistor 111 the same so as to set a ratio of currents flowing to both the transistors equal to a transistor size ratio. This is done by ensuring that the drain voltage of the first PMOS sense transistor 111 is the same as that of the output driver transistor 111. Consequently, the circuit solves the problem that a load current under which an over-current protection operates becomes inaccurate by a decrease in output voltage due to an abnormal operation of the over-current protection circuit in the case in which a difference of an input voltage VIN and an output voltage VOUT is small, and due to the influence of channel length modulation in the case in which the difference of an input voltage VIN and an output voltage VOUT is large. However, the circuits mentioned only provide a solution for an LDO linear regulator and no similar systems exist for voltage regulators with NMOS device at the driving stage.

U.S. Pat. No. 3,771,021 provides a solution with an npn transistor as an output driver. Reference is now made to FIG. 3. A circuit is mentioned that senses the current through the load and stops the supply of the base current to the output driver transistor. An over-current to a load is sensed in a differential amplifier. As this current increases, the current supply to the base of the output driver transistor decreases reducing the output voltage. This further increases the current drawn by the differential amplifier from the base of the output driver transistor resulting in regenerative foldback. This decreases the base current of the npn transistor, decreasing the output current. But this circuit uses a resistance in the load path to sense the over-current. This introduces the need for an extra connectivity to be made between the load and the regulator circuitry and also introduces error as the whole potential is now not available across the load. Also, devices manufactured in bipolar technology require comparatively more silicon area than CMOS technology devices.

Hence, as discussed above, over current protection systems exists for voltage regulators with PMOS driver stage. However, there is no similar suitable protection circuitry available for voltage regulators that use NMOS. Therefore, there is a need for over current protection system in linear voltage regulators that uses an NMOS driving stage. Most importantly, there is a need for protection circuitry in an open loop or a closed loop configuration of the voltage regulator using an NMOS driver device.

SUMMARY OF THE INVENTION

An embodiment of the instant invention provides a linear regulator with n-type pass transistor having an improved over-current protection circuit with a reduction in the required area need for the over-current protection circuitry. The solution provides an over-current protection circuit for a linear voltage regulator for both an open and a closed loop configuration.

In accordance with an embodiment, a voltage regulation system receives an input voltage at the input terminal and provides a regulated output voltage at the output node. The system comprises an error circuit responsive to a difference between a predetermined reference voltage and a function of the output voltage to produce an error signal, a current driver circuit, responsive to said error signal to adjust the current to the output load and reduce the error signal, a current sensing circuit coupled to the current driver circuit at its input terminal to sense the output current and coupled to a current sink device at it output terminal that sinks the current, and a feedback circuit coupled to the output of said current sensing circuit and providing feedback control signal to control the output current through the load.

In another embodiment, an over-current protection circuit for a linear voltage regulator with an NMOS driving stage comprises a PMOS current mirror circuit with input connected to drain of the sensing NMOS, a current sensing NMOS with gate and source connected to gate and source of the driving NMOS, a current sinking device with input connected to output of the PMOS current mirror circuit, and a feedback circuit with input connected to output of the PMOS current mirror circuit, wherein said feedback circuit controls the gate of the driving NMOS.

In an embodiment, a circuit comprises a comparator having first and second inputs and an output, the first input receiving a reference voltage. A feedback MOS transistor has its gate connected to the comparator output and a conduction terminal which generates a first voltage. A feedback voltage which is a function of the first voltage is applied to the second input of the comparator. A current drive MOS transistor has a gate connected to the comparator output and a conduction terminal generating a second voltage. A current sensing MOS transistor also has a gate connected to the comparator output and operates to sense current passing through the current drive MOS transistor. A current mirror is connected to the current sensing MOS transistor and generates a mirrored current output at a current node which is applied to a current sink. A feedback circuit has an input coupled to the current node and an output coupled to control a voltage at the comparator output.

In another embodiment, a circuit comprises a comparator having first and second inputs and an output, the first input receiving a reference voltage. A current drive MOS transistor has its gate connected to the comparator output and a conduction terminal generating an output voltage. A feedback voltage which is a function of the output voltage is applied to the second input of the comparator. A current sensing MOS transistor has a gate connected to the comparator output and operates to sense current passing through the current drive MOS transistor. A current mirror is connected to the current sensing MOS transistor and generates a mirrored current output at a current node which is applied to a current sink. A feedback circuit has an input coupled to the current node and an output coupled to control a voltage at the comparator output.

BRIEF DESCRIPTION OF THE DRAWINGS

A more complete understanding of the method and apparatus of the present invention may be acquired by reference to the following Detailed Description when taken in conjunction with the accompanying Drawings wherein:

FIG. 7 shows the implementation of an open loop linear regulator having over-current protection circuit; and.

DETAILED DESCRIPTION OF THE DRAWINGS

The present invention discloses a voltage regulator with an NMOS output driver transistor having an improved over-current protection circuitry. Alternate embodiments of the circuitry are provided for open and closed loop configurations. In addition to the regular over-current limiting circuitry, a current sink is provided as an indicator for providing a control flag for the condition of over current. Feedback logic is also provided which couples to the error amplifier for turning off the over-current protection circuitry devices when a control flag is generated.

Figure 1:
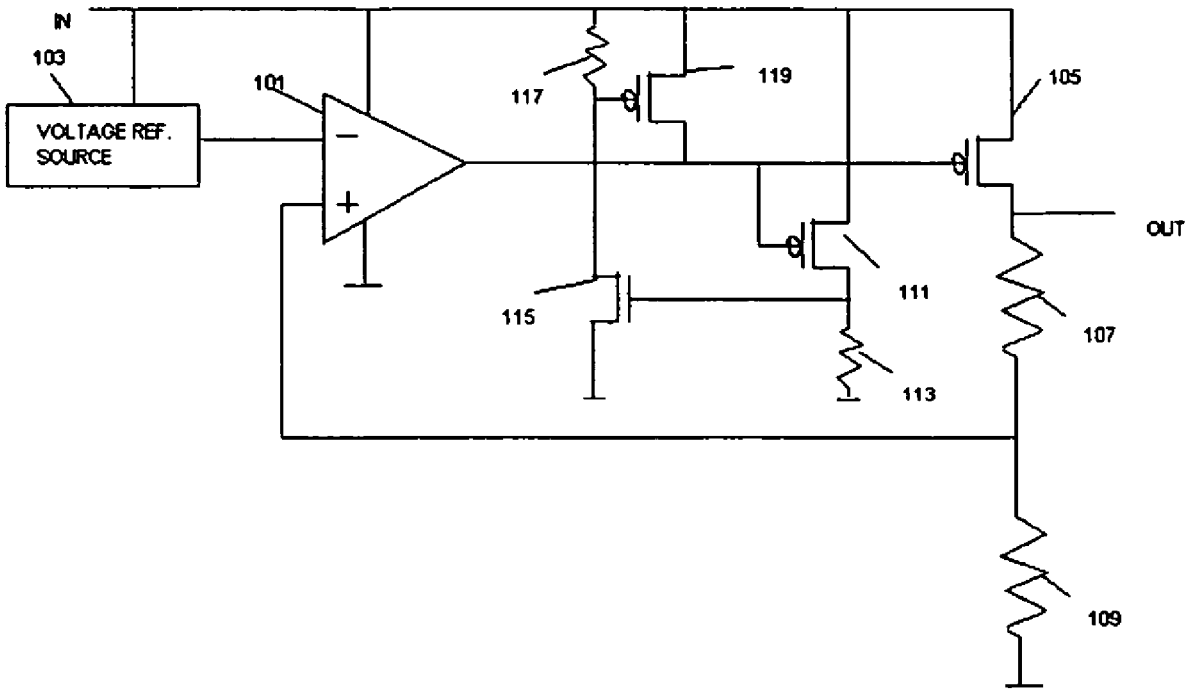
FIG. 1 shows a configuration of a conventional over-current protection circuit for a voltage regulator with PMOS as an output driver.
Figure 2:
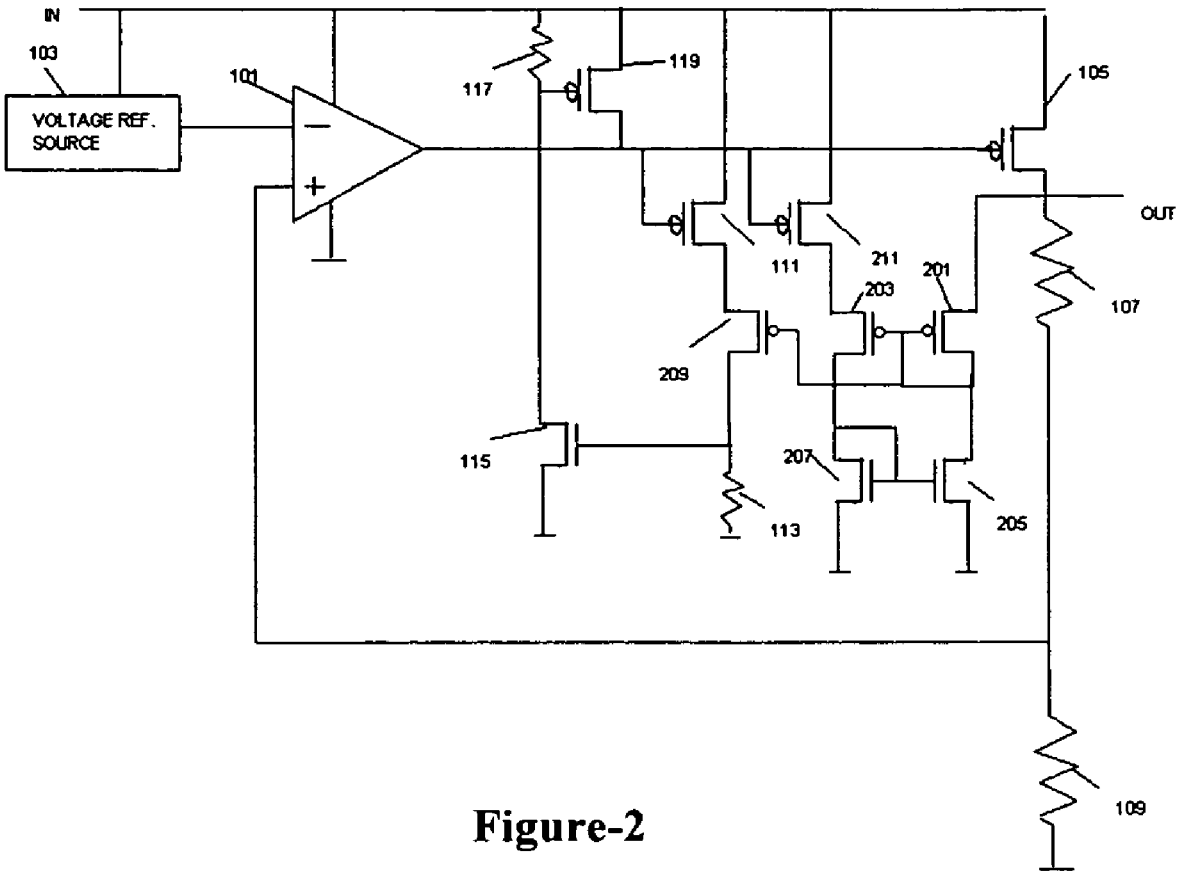
FIG. 2 shows an improved prior art circuit.
Figure 3:
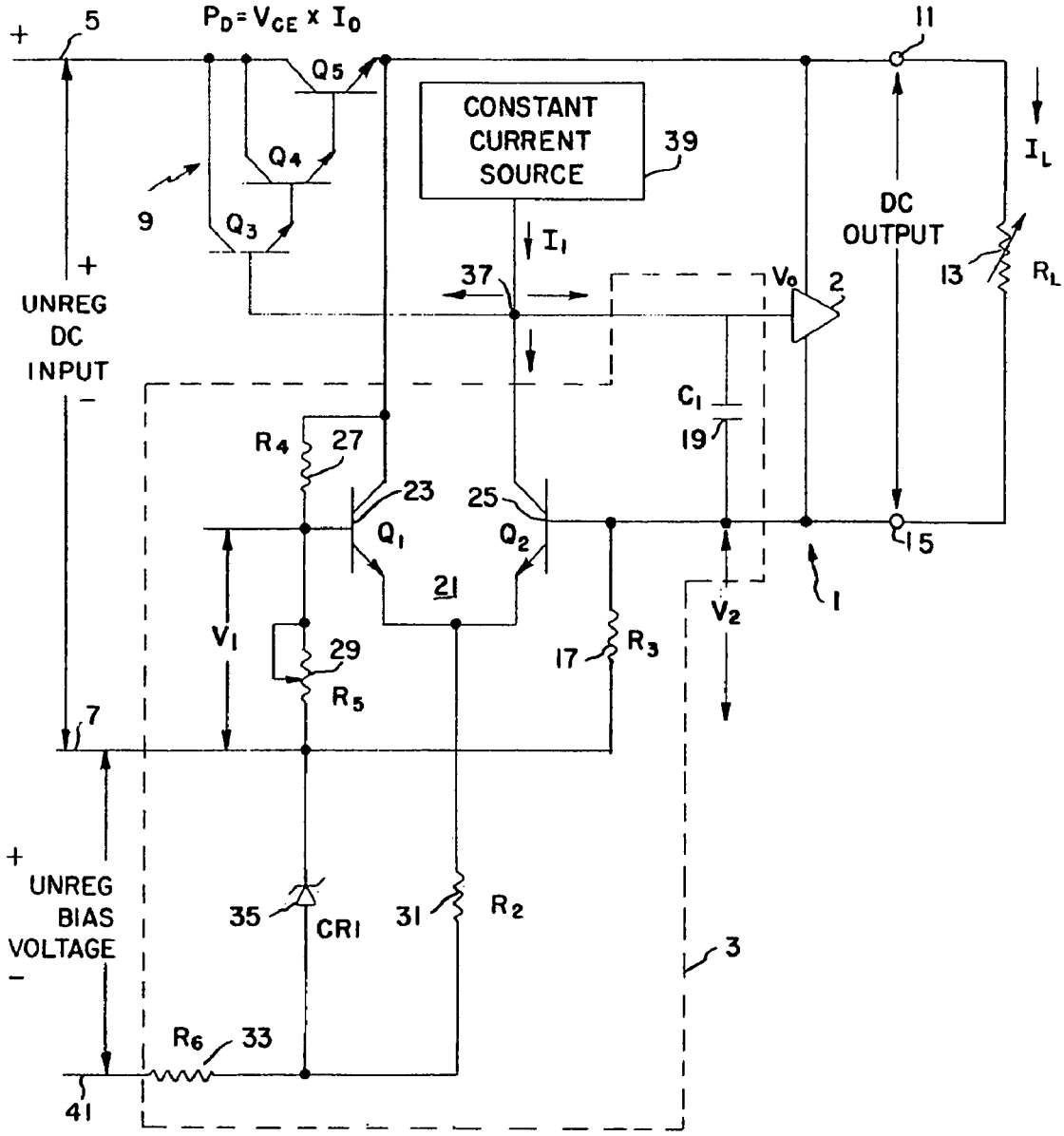
FIG. 3 shows a configuration of over-current protection circuit for a voltage regulator with an npn as an output driver.
Figure 4:
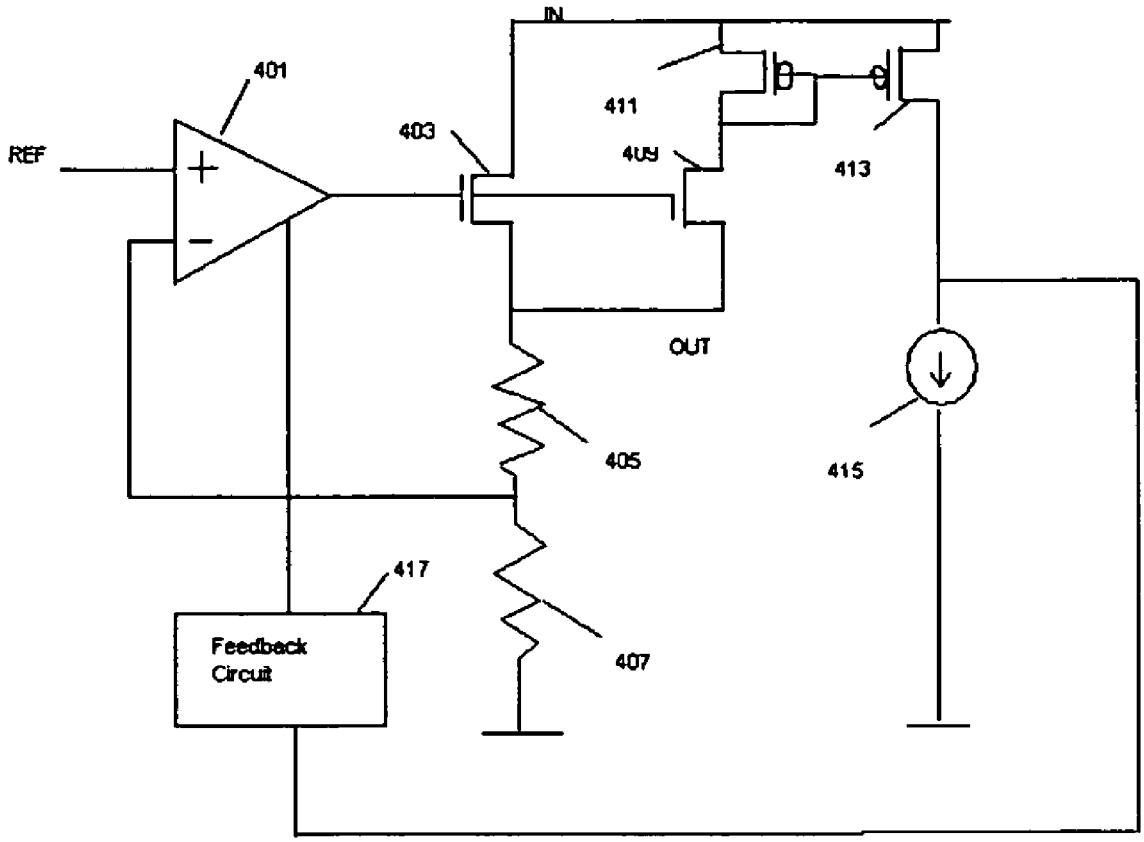
FIG. 4 shows an embodiment of a closed loop voltage regulator configuration with NMOS output driver having the over-current protection circuit.

FIG. 4 shows one embodiment of the present invention for a closed loop configuration. A reference voltage is connected to the non-inverting input of an error amplifier 401. The output of the error amplifier 401 is connected to a gate of a driver NMOS 403 and a gate of a sensing NMOS 409. The drain of the driver NMOS 403 is connected to IN which is a supply voltage. The sources (conduction terminals) of the driver NMOS 403 and the sensing NMOS 409 are connected to each other. The source of the driver NMOS 403 is connected to the output load. A scaled voltage from the source of the driver NMOS 403, through resistances 405 and 407, is fed to the inverting input of the error amplifier 401. The drain (conduction terminal) of the sensing NMOS 409 is connected to a diode connected PMOS 411 connected to IN. Now, as the gate-to-source voltage of the driver PMOS 403 and the sensing NMOS 409 are the same, the currents in the two transistors are in the ratio of their sizes, except for a small error due to channel length modulation, which is insignificant. The gate of the diode connected PMOS 411 is connected to gate of a PMOS 413 whose source is connected to IN and whose drain is connected to a current sink 415. The value of the current sink 415 is a scaled value of the over-current limit. The drain of PMOS 413 is connected to a feedback circuit 417 which controls the regulator, limiting the supply of current, in case of over-current condition.

In normal functioning, when the output current is within limits, current through the sensing NMOS 409 is a proportion of the current of current through the driver NMOS 403. The current is mirrored through a current mirror consisting of the PMOS 411 and the PMOS 413. The drain current of PMOS 413 is thus a scaled value of the current through driver NMOS 403. This current is less than the current capacity of the current sink 415. This pulls the drain of the PMOS 413 down, switching the feedback circuit 417 off. Thus, the normal functioning of the regulator is ensured.

In case an over-current condition occurs at the drain of the driver NMOS 403, the current through the sensing NMOS 409 also increases in the same proportion. This current is mirrored in the PMOS 413 through the PMOS 411. The current through current sink 415 is set equal to this mirrored value of the over-current. The mirrored current, if higher than the current value of the current sink 415 forces the drain of the PMOS 413 high, turning the feedback circuit 417 on. The feedback circuit 417 then forces the gate of driver NMOS 403 down, limiting the current to the load.

Figure 5:
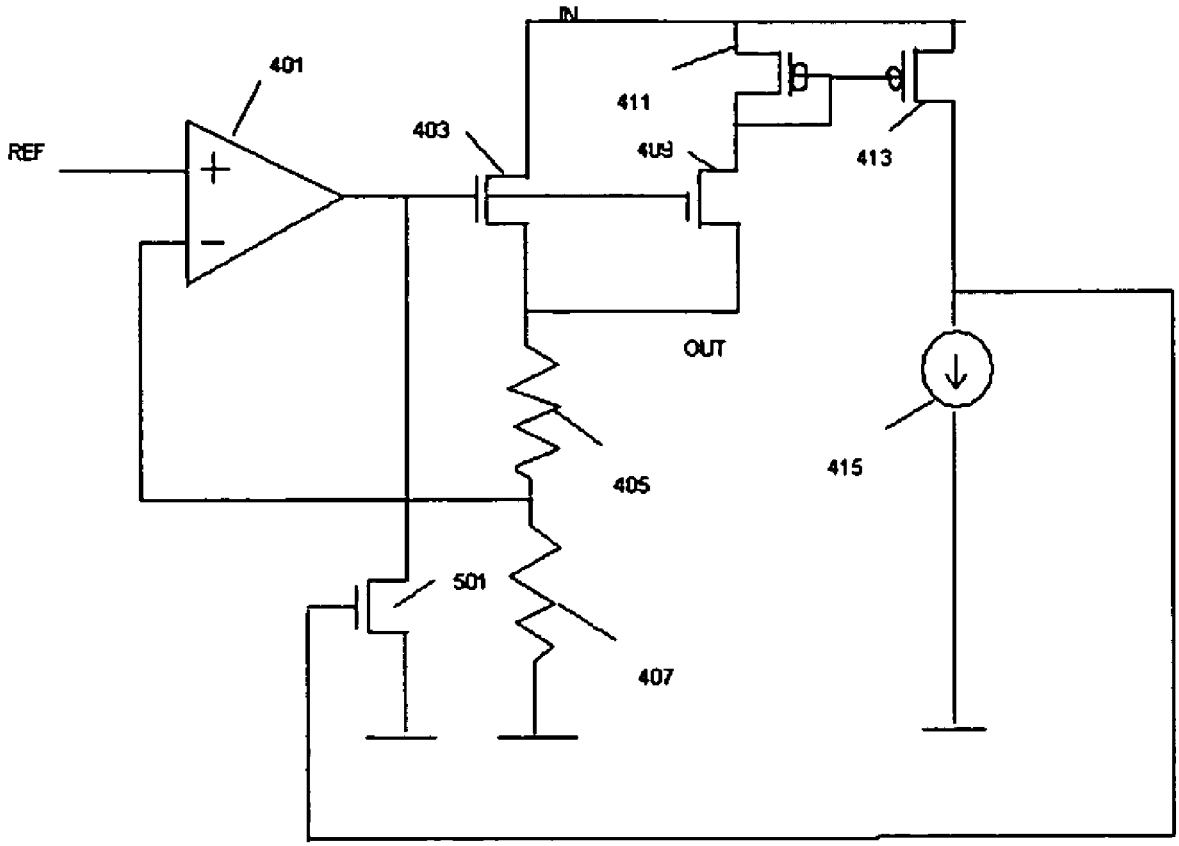
FIG. 5 shows an embodiment of a closed loop voltage regulator configuration with NMOS output driver having the over-current protection circuit with the feedback circuit implemented through an NMOS.

FIG. 5 shows an embodiment of the present invention with the feedback circuit 417 implemented through an NMOS 501. The source of the NMOS 501 is connected to ground and the gate of the NMOS 501 is connected to the drain of the PMOS 413. The drain of the NMOS 501 is connected to gate of the driver NMOS 403. In normal operation, the drain of the PMOS 413 is low and the NMOS 501 is off. This allows the gate of the driver NMOS 403 to be controlled by the error amplifier 401. However, in case of an over-current condition, the gate of the PMOS 413 goes high turning on the NMOS 501. The NMOS 501 pulls down the gate of the driver NMOS 403. This stops the supply of high current to the load.

Figure 6:
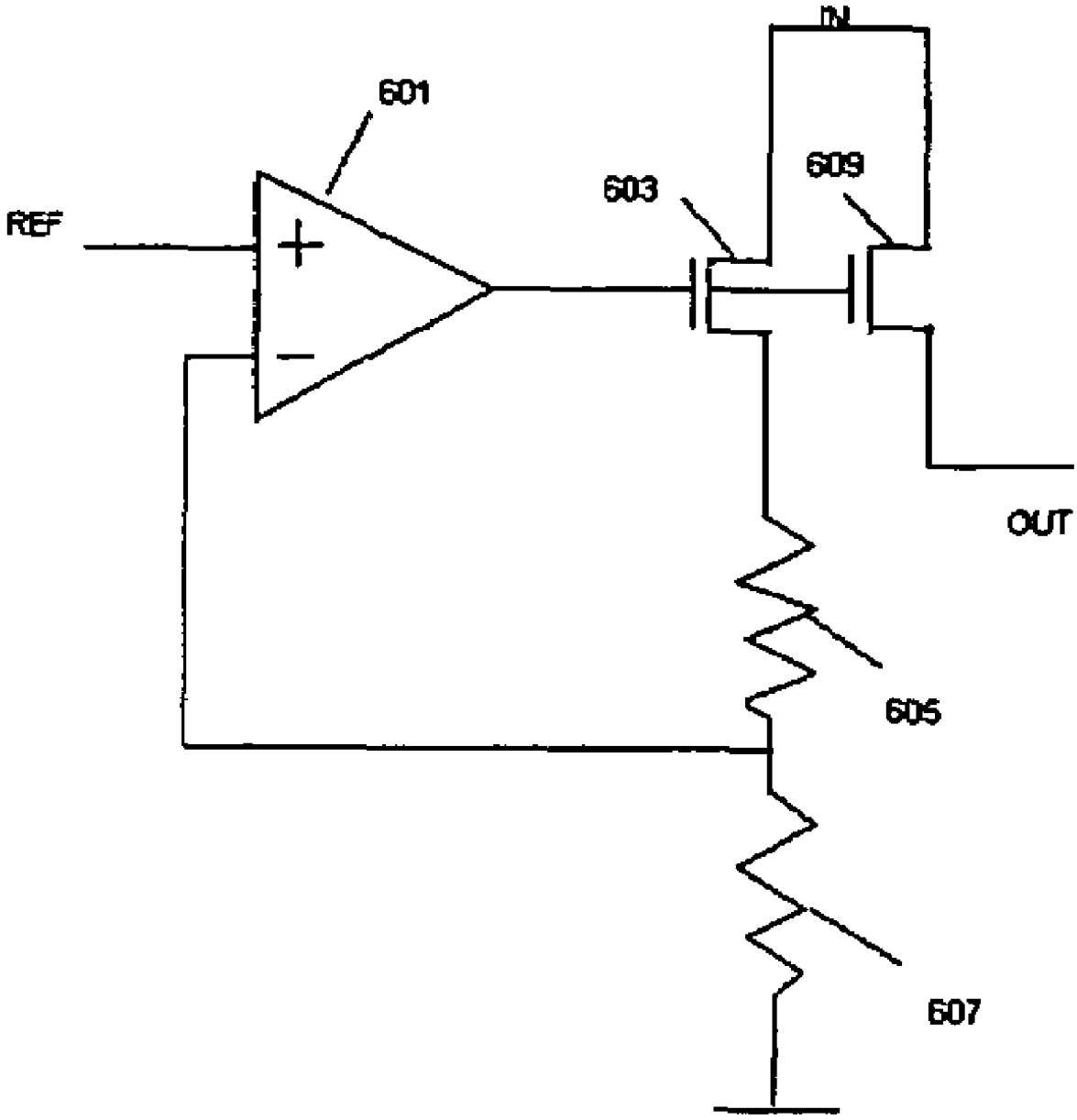
FIG. 6 is an open loop linear regulator.

FIG. 6 shows an open loop linear regulator. A reference voltage is connected to the non-inverting input of an error amplifier 601. The output of the error amplifier 601 is connected to a gate of a feedback NMOS 603 and a gate of a driver NMOS 609. The drain of the feedback NMOS 603 and the driver NMOS 609 are connected to IN. A scaled voltage from the source of the feedback NMOS 603 through resistances 605 and 607 is fed to the inverting input of the error amplifier 601. The source of the driver NMOS 609 is connected to the output load. This configuration of an open loop linear regulator makes the stability of the linear regulator independent of the output capacitive load. This is ensured by keeping the driver NMOS 609 out of the feedback loop. Thus, the regulator can supply a range of capacitive loads without any impact on its stability. However, in such a configuration, the over-current problem is further aggravated by the fact that the driver NMOS 609 is of comparatively much greater size. Because of this, very large currents flow through the driver NMOS 609 if the output voltage level falls to zero.

Figure 7:
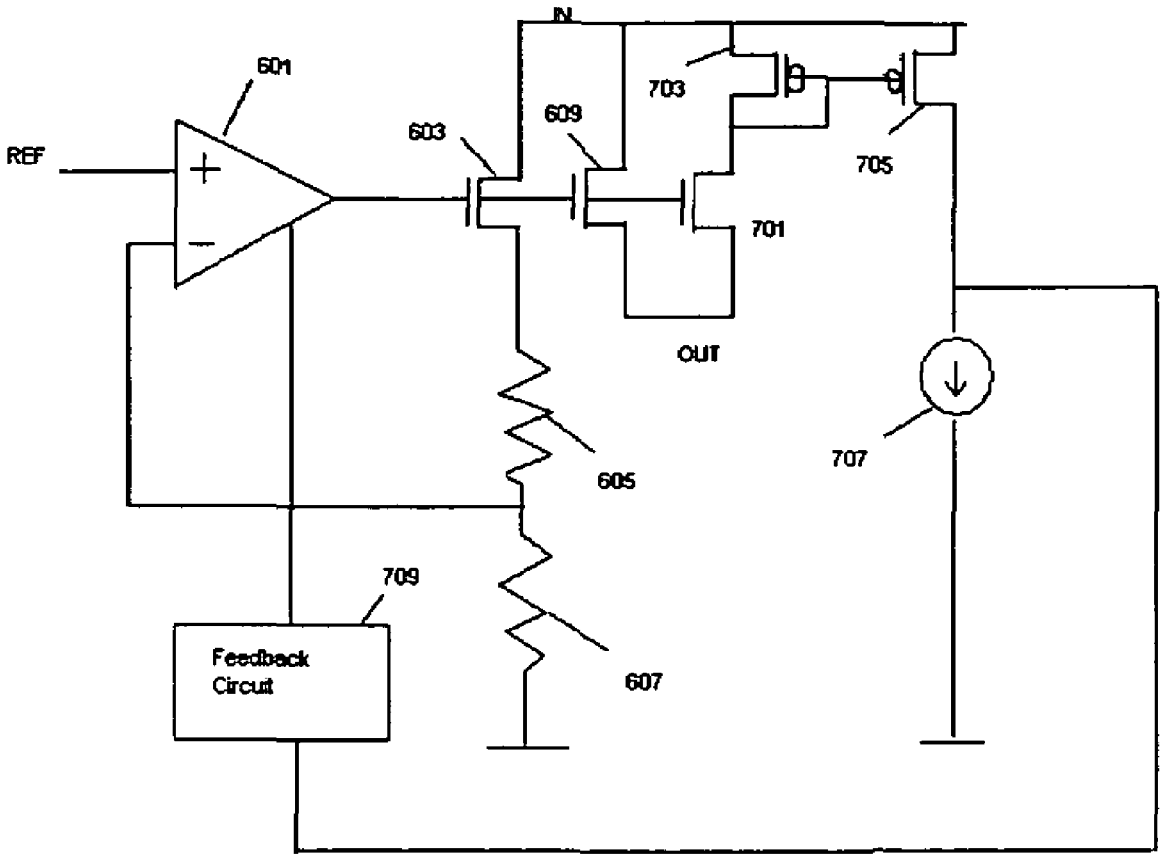
Figure 8A:
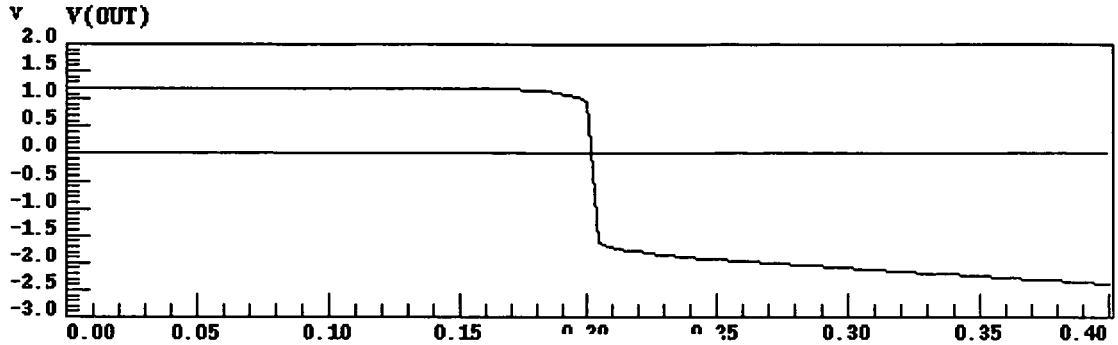
FIGS. 8A-8D show plots at various nodes with varying load current for the closed loop configuration.
Figure 8B:
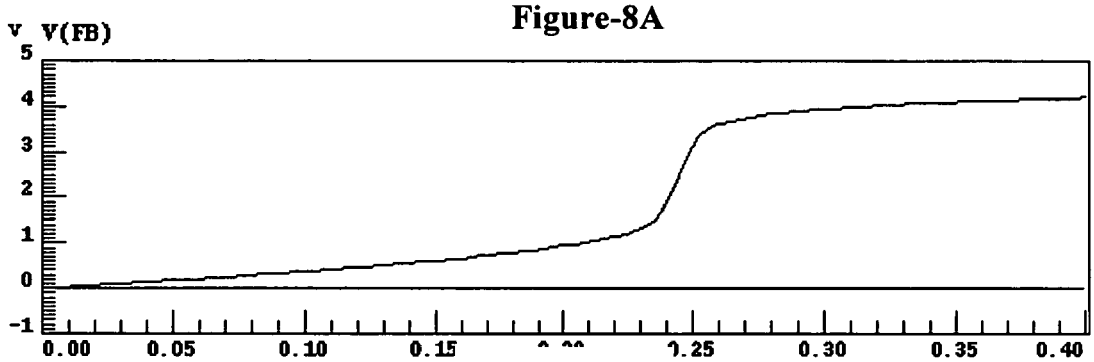
Figure 8C:
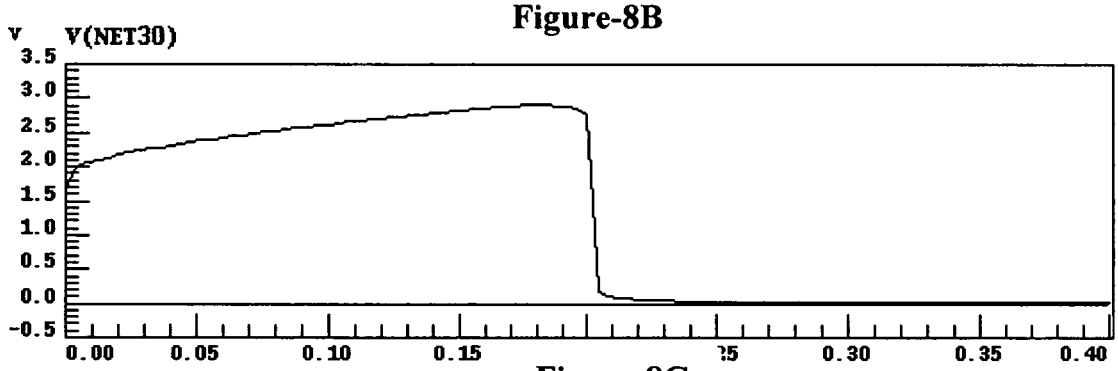
Figure 8D:
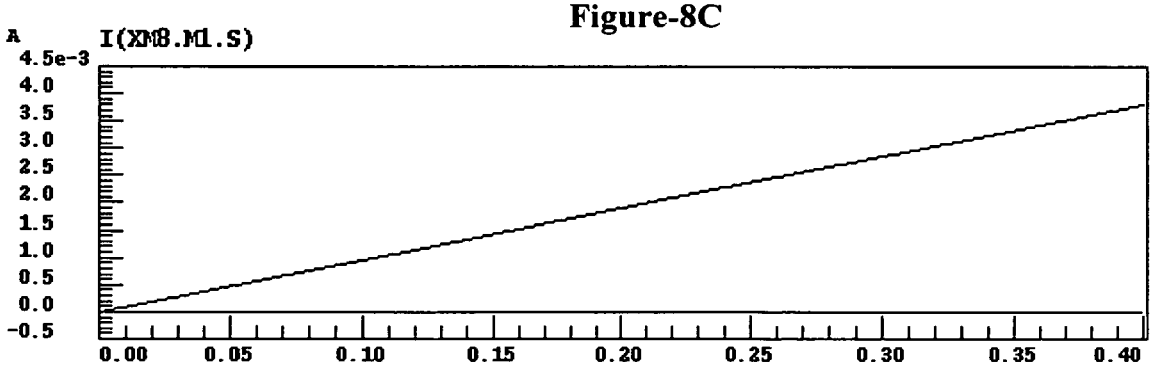

FIG. 7 shows the implementation of the over-current protection circuit in an open loop linear regulator. The non-inverting input terminal of the error amplifier 601 is connected to a reference voltage. The output of the error amplifier 601 is connected to the gate of the feedback NMOS 603, the driver NMOS 609 and a sensing NMOS 701. The source of the sensing NMOS is connected to the source of the driver NMOS 609 and the drain of the sensing NMOS 701 is connected to a current mirror consisting of a PMOS 703 and a PMOS 705. The current through the sensing NMOS 701 is a scaled value of the current through 609 depending on the ratio of their sizes. The drain of the PMOS 705 is connected to a current sink 707 and to a feedback circuit 709. The feedback circuit 709 provides an input to the error amplifier 601 (or may have the configuration shown in FIG. 5). The current through the current sink 707 is set as a scaled value of the over-current limit.

In the normal functioning, the current through the sensing NMOS 701 is mirrored through the PMOS 705. The current through the PMOS 705 is less than the current capacity of the current sink 707. The drain of the PMOS 705 is pulled down switching the feedback circuit 709 off and the regulator functions normally. However, in an over-current state, the current through the PMOS 705 exceeds the capacity of the current sink 707, pulling the drain of the PMOS 705 high. This turns on the feedback circuit 709 and pulls down the gate of the driver NMOS 609 stopping high current. Although an NMOS driver has been used in the above embodiments of the present invention, it would be obvious to a person skilled in the art that the present invention can be extended to a linear regulator with an npn driver.

The plot of various nodes with varying load current is shown in FIGS. 8A-8D for a closed loop configuration. As can be seen from the graph, the feedback NMOS 501 turns on pulling the gate of the driver NMOS 403 down as the load current increases above the set value of 200 mA. The over-current protection circuit comes into operation only when the current approaches and exceeds the set limit. Another advantage of the present invention is the implementation of a soft start mechanism by the same circuit arrangement. When the regulator is switched on the load capacitor offers a virtual short circuit to ground. As large current would tend to flow under this condition, the over-current protection circuit operates to limit the charging current at the pre-determined current limit. Thus, the capacitor is charged slowly thereby providing a soft start to the regulator.

Although preferred embodiments of the method and apparatus of the present invention have been illustrated in the accompanying drawings and described in the foregoing detailed description, it will be understood that the invention is not limited to the embodiments disclosed, but is capable of numerous rearrangements, modifications and substitutions without departing from the spirit of the invention as set forth and defined by the following claims.

What is claimed is:

1. A circuit that receives an input voltage at an input terminal and provides a regulated output voltage at an output node, comprising:

an error circuit responsive to a difference between a predetermined reference voltage and a voltage which is a function of the output voltage to produce an error signal;

a current driver circuit, responsive to said error signal to adjust a current to the output node and reduce the error signal;

a current sensing circuit coupled to the current driver circuit at its input terminal to sense the output current and coupled to a current sink device which sinks a current output from the current sensing circuit; and a feedback circuit coupled to the output of said current sensing circuit and providing a feedback control signal to control the current to the output node, wherein said feedback circuit comprises an NMOS transistor with its gate connected to the output of said current sensing circuit and its drain connected to the input of said current driver circuit, the feedback NMOS transistor responding to the feedback control signal to sink current from the error signal output from the error circuit and input to the current driver circuit.

2. The circuit as in claim 1, wherein said feedback circuit is activated when the current passing through said current sink exceeds its current sinking capacity.

3. The circuit as in claim 1, wherein said current sensing circuit comprises a transistor to sense the current and a current mirror circuit for propagating the sensed current through said current sink device.

4. The circuit as in claim 3, wherein said transistor is a NMOS device and said current mirror circuit comprises PMOS devices.

5. The circuit as in claim 1, wherein said driver circuit is a NMOS transistor.

6. A circuit providing over-current protection for a linear voltage regulator with an NMOS driving stage, comprising:

a current driving NMOS transistor;

a current sensing NMOS transistor with a gate and source connected to a gate and source of the driving NMOS transistor;

a PMOS current mirror circuit with an input connected to a drain of the current sensing NMOS;

a current sinking device with an input connected to an output of the PMOS current mirror circuit; and a feedback circuit with an input connected to the output of the PMOS current mirror circuit, the feedback circuit controlling the gate of the current driving NMOS transistor, wherein said feedback circuit comprises an NMOS transistor with its gate connected to the current sinking device and its drain connected to the gates of the current driving NMOS transistor and current sensing NMOS transistor, the feedback NMOS transistor operating to sink current from the gates of the current driving NMOS transistor and current sensing NMOS transistor.

7. A circuit, comprising:

a comparator having first and second inputs and an output, the first input receiving a reference voltage;

a feedback MOS transistor having a gate connected to the comparator output and a conduction terminal generating a first voltage, wherein a feedback voltage which is a function of the first voltage is applied to the second input of the comparator;

a current drive MOS transistor having a gate connected to the comparator output and a conduction terminal generating a second voltage;

a current sensing MOS transistor having a gate connected to the comparator output and operating to sense current passing through the current drive MOS transistor;

a current mirror connected to the current sensing MOS transistor and generating a mirrored current output at a current node;

a current sink coupled to the current node; and a feedback circuit having an input coupled to the current node and an output coupled to control a voltage at the comparator output, wherein said feedback circuit comprises a MOS transistor with its gate connected to the current node and its conduction terminal connected to the output of the comparator and the gates of the feedback MOS transistor, current drive MOS transistor and current sensing MOS transistor.

8. The circuit of claim 7 wherein the feedback MOS transistor, current drive MOS transistor and current sensing MOS transistor are n-channel devices and the current mirror is a p-channel current mirror.

9. The circuit of claim 8 further comprising voltage divider having an input coupled to receive the first voltage and an output generating the feedback voltage.

10. The circuit of claim 8 wherein the current sensing MOS transistor has a conduction terminal connected to the conduction terminal of the current drive MOS transistor.

11. A circuit, comprising:

a comparator having first and second inputs and an output, the first input receiving a reference voltage;

a current drive MOS transistor having a gate connected to the comparator output and a conduction terminal generating an output voltage, wherein a feedback voltage which is a function of the output voltage is applied to the second input of the comparator;

a current sensing MOS transistor having a gate connected to the comparator output and operating to sense current passing through the current drive MOS transistor;

a current mirror connected to the current sensing MOS transistor and generating a mirrored current output at a current node;

a current sink coupled to the current node; and a feedback circuit having an input coupled to the current node and an output coupled to control a voltage at the comparator output, wherein said feedback circuit comprises a MOS transistor with its gate connected to the current node and its conduction terminal connected to the gates of the current drive MOS transistor and current sensing MOS transistor, the feedback MOS transistor responding to the current node by drawing current from the gates of the current drive MOS transistor and current sensing MOS transistor.

12. The circuit of claim 11 wherein the current drive MOS transistor and current sensing MOS transistor are n-channel devices and the current mirror is a p-channel current mirror.

13. The circuit of claim 12 further comprising voltage divider having an input coupled to receive the first voltage and an output generating the feedback voltage.

14. The circuit of claim 12 wherein the current sensing MOS transistor has a conduction terminal connected to the conduction terminal of the current drive MOS transistor.

* * * * *